United States Patent [19]

Kotcharian

[11] 3,957,170

[45] May 18, 1976

[54] SUPPORTING DEVICE FOR A RIGID VEHICLE-BORNE HEAT-INSULATED TANK

[75] Inventor: Michel Kotcharian, Paris, France

[73] Assignee: Technigaz, Paris, France

[22] Filed: Mar. 26, 1975

[21] Appl. No.: 562,059

[30] Foreign Application Priority Data

Apr. 3, 1974 France ..... 74.11783

[52] U.S. Cl. ..... 220/9 LG; 114/74 A

[51] Int. Cl.[2] ..... B65D 25/18

[58] Field of Search ..... 114/74 A; 220/9 LG, 220/15

[56] References Cited

UNITED STATES PATENTS

| | | | |
|---|---|---|---|
| 2,520,883 | 8/1950 | Kornemann et al. | 114/74 A |
| 3,839,981 | 10/1974 | Gilles | 220/15 |
| 3,842,775 | 10/1974 | Edwards et al. | 114/74 A |

*Primary Examiner*—Trygve M. Blix
*Assistant Examiner*—Stuart M. Goldstein
*Attorney, Agent, or Firm*—Kenyon & Kenyon Reilly Carr & Chapin

[57] ABSTRACT

A device for supporting a rigid tank for very cold or hot fluids in a vehicle comprising a continuous annular horizontal foot-plate surrounding and integral with a tank and freely resting on a continuous annular bed-plate forming the top of the resiliently bearing base secured to the vehicle structure and surrounding the tank, heat insulating material being interposed between said foot- and bed-plates and consisting of blocks juxtaposed to form a ring with the top surface of which the foot-plate is in sliding contact.

13 Claims, 4 Drawing Figures

I
1
8
4
29
9
38
36
32
30
34
5
37
33
31
2
3
39
40
35
16
15
13
14
22
21
20
18
19
17
7
25
12
23
24
11
10

α
R
41
6
8
1
7
II
L
25
12
4
24
11
13
9
10
38
35
IV
30
5
33
37
31
2
3
42

SUPPORTING DEVICE FOR A RIGID VEHICLE-BORNE HEAT-INSULATED TANK

The present invention is generally concerned with and relates essentially to a device for supporting an enclosure with a rigid self-supporting structure for storing, conveying, preserving or confining contained products, materials or goods in particular fluids at a temperature very different from ambient or room temperature, i.e. very hot or very cold fluids such as for instance in particular methane-based liquified natural gases, liquified petroleum gases and other cryogenic materials or like very cold substances, in any transporting vehicle or rolling, flying or floating carriage or haulage unit such in particular as a tanker ship or the like undergoing repeated, periodical or intermittent spurious, interfering or disturbing motions such as roll and pitch forced thereupon by the outside environment. Such an aforesaid enclosure consists generally of a heat insulated vessel, envelope or shell forming a tank, vat, bin or like container and constituting an individual separate unit exhibiting an adequate design rigidity, stiffness or strength for being supported by itself without collasping. The invention is also directed to the various applications and uses resulting from putting said improved device into practice as well as to the systems, assemblies, arrangements, contrivances, appliances, equipments and plants provided with such devices and by way of new industrial products or articles of manufacture to the tanks fitted with such devices and to the vehicles fitted with such tanks supported in that way.

In the prior state of the art there are already known heat insulated tanks or vats for instance of spherical or round cylindrical shape adapted to the aforesaid purpose or use and mounted in particular in the hold or a compartment of the hull of a tanker or like transport ship. Such a tank is supported by a device comprising a continuous annular bearing foot-plate forming a kind of encompassing ring with a bottom wall surface which is at least approximately flat and substantially horizontal relative to said vehicle and surrounding said tank while being fast or integral therewith, said foot-plate resting simply and freely on a continuous annular platform or bed-plate forming the top part of a base frame or pedestal secured to the vehicle structure and constituting a resilient or springy suspension-carrying springer pad surrounding said tank. Co-operating anchoring means are provided between said bearing foot-plate and the surface of the seating platform or bed-plate supporting same, these anchoring means being adapted to prevent said tank from being bodily displaced mechanically through any relative motion at least horizontally or in parallel relation to said seating surface under the action of outer forces but allowing a local movement through thermal deformation (in particular through contraction and expansion) in substantially radial directions, i.e. directions normal to the tank wall surface. These anchoring means comprise substantially radially extending spaced guide grooves on said seating surface as well as projecting keys secured underneath said bearing foot-plate and freely engaging said grooves in sliding relationship therewith, respectively, thereby forming a movable connection like a kind of slidable keying. The aforesaid bearing foot-plate is rigidly connected to or made integral with a flat annular collar-like frame externally surrounding said tank and rigidly connected to or integral with the latter. This known supporting structure thus consists on the one hand of an upper depending cylindrical or conical shroud forming a skirt tangential to the horizontal equatorial section of the spherical tank while extending downwards where it terminates in a peripheral supporting flange and on the other hand of a lower framework or stand forming a skirt serving as a seating base projecting upwards from the inner bottom of the ship with which it is rigidly connected or integral, this base skirt being provided at its top portion with a peripheral base flange on which is resting the supporting flange of the upper skirt integral with the tank. These skirts form the aforesaid annular bearing foot-plate and the seating platform, bed-plate, base or pedestal, respectively. The relatively variable peripheral connection between the tank and its mounting device on board the ship serves for transmitting horizontal and vertical forces as well as other dynamic effects resulting from the own motion of the ship at sea caused in particular by the swell or surge of the sea and the wind as well as for reducing or cancelling the influence exerted by any deformation of the hull upon the tank and by any thermal deformation of the latter upon the hull.

The aforesaid resilient suspension means consist of rubber elements or pads spaced and distributed peripherally in a same relative substantially horizontal laying plane on the seating flange of the lower skirt, these elements being adapted to absorb the twist motions. The known tank is thus held against motion relative to any torque of mechanical origin while retaining some degree or extent of freedom of longitudinal displacement allowing local movements of thermal origin.

This kind of continuous supporting by skirts offers the inconvenience on the one hand of requiring the use in particular for large tanks of a very massive main working member (hence difficult to be worked) for connection between the skirt and the tank and on the other hand of preventing an easy locating or detection of cracks in the tank wall at the connection area. Moreover it would involve adjusting and building or manufacturing difficulties and the requirement of having relatively very stiff or reinforced skirts owing to their great heights. At least the skirt rigidly connected to the tank should be made from noble metal withstanding very cold conditions so that in view of the relatively large size of the skirt its manufacture is expensive.

There are furthermore also known in particular spherical or cylindrical self-supporting tanks mounted on board ships and carried in a discontinuous fashion at discrete points by separate suspension devices or hangers forming self-compensated toggle or linked systems.

A main object of the invention is to overcome the aforesaid drawbacks while satisfactorily solving substantially the same technical problem but without the use of toggle or linked systems by providing a suitable supporting device which is characterized in that heat insulating material is included in said device while being interposed between said bearing foot-plate and said seating platform or bed-plate and consisting of intermediate heat insulating blocks juxtaposed end to end in series in an at least approximately continuous or possibly discontinuous ring-shaped arrangement while for instance leaving gaps or spacings between the successive adjacent blocks, respectively, while form with their top surface or upper wall an at least approximatively uniform surface which is engaged by said bearing foot-plate in particular in direct slidable contacting relationship.

According to another characterizing feature of the invention the aforesaid grooves of the aforesaid anchoring means consist of transversely or radially extending flutes forming elongated hollows, depressions or like recesses provided in the top surface of the aforesaid heat insulating blocks constituting an upper coping, deck or shelf for said sliding contact while being preferably regularly distributed over this surface wheras the aforesaid keys of said anchoring means consist of spaced mating or complementary ribs or ridges preferably provided in plates or sheets of heat insulating material secured for instance adjustably in position underneath said bearing foot-plate, said seating platform or bed-plate comprising means for holding said heat insulating blocks against motion in radial or transverse directions.

According to still a further characterizing feature of the invention said bearing foot-plate consists directly of one aforesaid collar member possibly reinforced in turn by gussets or brackets whereas according to another characterizing feature of the invention the aforesaid springer comprises a substantially horizontal annular beam coaxial with said tank and forming a rigid frame resting upon a resilient support secured to said vehicle structure said beam comprising a top ledge or flange preferably forming a hollow recess with parallel bilateral vertical upstanding or upward projecting walls or edges and having substantially the shape of an annular trough or channel receiving or accommodating the bottoms of said heat insulating blocks forming said seating platform or bed-plate.

According to still another characterizing feature of the invention said resilient suspension means consist of a series of like successive quaternary systems peripherally distributed preferably substantially uniformly in said relative substantially horizontal laying plane, each quaternary assembly being for instance substantially symmetrical with respect to two relative vertical perpendicular centre planes oriented in a direction extending locally transversely of, or in radial normal relation to the tank wall and in a locally tangential, circumferential or longitudinal direction with respect to this wall, respectively.

In the case of a substantially spherical tank and according to still a further characterizing feature of the invention said laying plane or supporting level is located below the relative horizontal equatorial plane of said tank and according to another characterizing feature of the invention the tank is heat-insulated outside thereof so that said pedestal or springer remains fully free and disengaged from heat insulating material which preferably comprises on the one hand a layer of cellular for instance synthetic or artificial material such as expanded polyurethane, polyvinul chloride foam or a like plastics material coating or lining the lower part of said tank which is advantageously surrounded or enclosed by a lagging or packing of solid, incoherent or pourable for instance powdery heat insulating material such as perlite filling the surrounding space and on the other hand a filling or packing for instance of perlite about the upper portion of said tank up to the level of the tops of said heat insulating blocks.

The aforesaid arrangements offer in particular the following advantages:

— The supporting contrivance is carried out in a truly continuous, i.e. practically perfect manner.

— Said intermediate heat insulating blocks form a very effective shield for protecting against heat enabling to limit to a large extent any heat flux or transfer thereby achieving an acceptable temperature for the rubber parts or component members of the resilient suspension system.

— As the continuous supporting for instance circular ring is of a size relatively reduced in height it requires much lesser noble metal than the aforesaid known construction and is therefore of a less expensive, i.e. cheaper manufacture; owing to its continuity it enables the relative mutual sliding motions of the surfaces which are mutually in simple or free contact with each other to take place on the level of the top faces of said heat insulating blocks upon the contraction of the tank for instance when chilling or cooling same; the respective aggregate or added heights of this ring and heat insulating blocks are moreover adequate to enable to further clear the tank in order to fit a heat insulating lagging or lining between the supporting device and the tank wall.

— The overall suspension system supporting the whole construction on an assembly of alternatingly arranged sets of resilient elements for damping swinging or oscillating motions or for absorbing shocks enables on the one hand to absorb the roll and pitch forces induced by the own or relative movements of the ship and on the other hand to dynamically and statically decouple the tank together with its supporting device on the one hand from the supporting plane and on the other hand so as to make the combination of the tank and of its supporting device substantially independent of the forces or stresses induced by the deformations of the supporting plane (integral with or bound to the vehicle structure, for instance the ship's hull) and accordingly insensitive to such forces or stresses; thus the deformations of the ship's hull are not fully retransmitted to the tank owing to the working capability of the resilient suspension in compression and shearing.

— The relative sub-equatorial position of the supporting plane enables the supporting device to be sufficiently cleared or spaced from the tank wall for enabling to apply a heat insulation on the lower portion of the tank.

— The fact that the lower portion of the supporting device up to the top surfaces of the heat insulating blocks is substantially devoid of any heat insulation prevents the cold thermal flux originating from the tank from passing through the rubber component members or parts of the resilient suspension system which otherwise would create the risk of deteriorating same.

— The relative sub-equatorial position of the supporting device moreover enables to lower the supporting plane on the ship's hull down to about the level of the neutral axis of the ship's hull thereby reducing the influence of the hull deformations substantially through bending or flexure.

The supporting device may be adapted to a tank of any not exclusively spherical or cylindrical shape provided that the lower portion of the tank be narrowed, tapered or diminished sidewise or transversely, i.e. exhibit a wall pitching or sloping downwards and inwards from top to bottom so that this wall be spaced or cleared enough from the supporting device to enable applying the heat insulation. The tank may advantageously have a shape of revolution in particular about a substantially vertical geometrical axis relative to the vehicle. Besides alternatively one portion only of the tank wall could be a surface of revolution whereas the remaining portions could be polyhedral surfaces preferably of substantially regular shape or at least having uniformly distributed flat faces. In the case where the tank has vertical side walls as for instance a cylindrical tank with a vertical longitudinal axis it is necessary that the supporting device be spaced or cleared from the walls thereby providing an overlapping or cantelever structure which may sometimes be of impeding character (through its bulk or size, etc . . . )

The invention therefore brings about an obvious technical progress, advance or improvement with respect to the devices previously known and it offers the advantage of a simplicity of construction hence an economical manufacture or building and erection, installation or assembly, a practically negligible maintenance, an effective action and a great reliability, dependability or operating safeness.

The invention will be better understood and further objects, characterizing features, details and advantages thereof will appear more clearly as the following explanatory description proceeds with reference to the accompanying diagrammatic drawings given by way of non-limitative example only illustrating a presently preferred specific form of embodiment of the invention and wherein.

Figure 1:
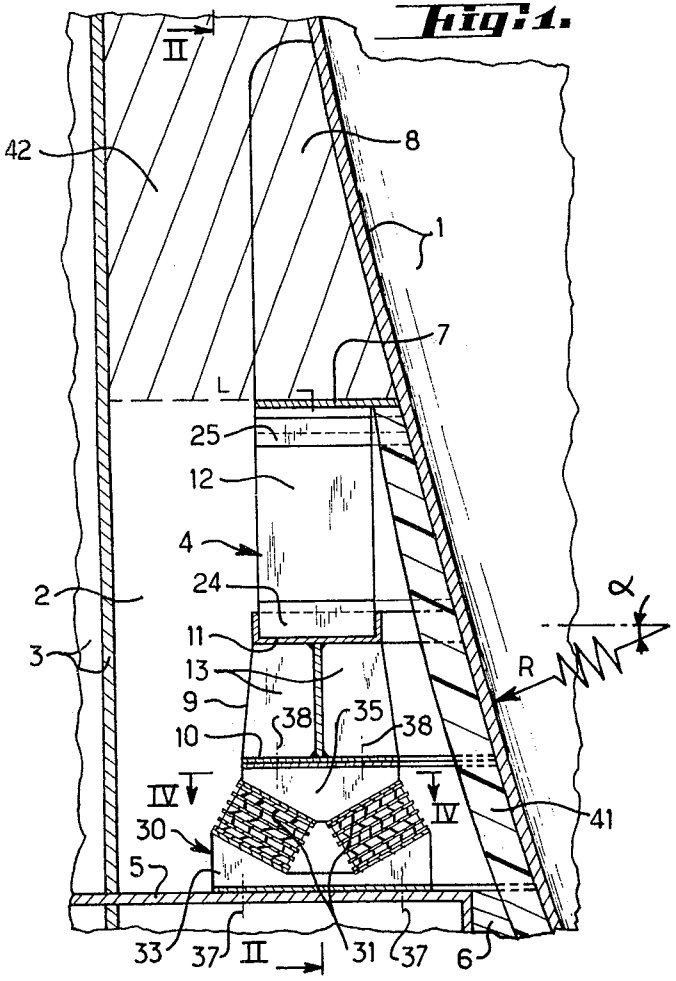
FIG. 1 shows a fragmentary view in cross-section taken upon the broken line I—I in FIG. 2, of a tank and its mounting system on board a ship, and illustrating one tank wall portion, one portion of the inner ship's hull and the supporting device according to the invention.
Figure 3:
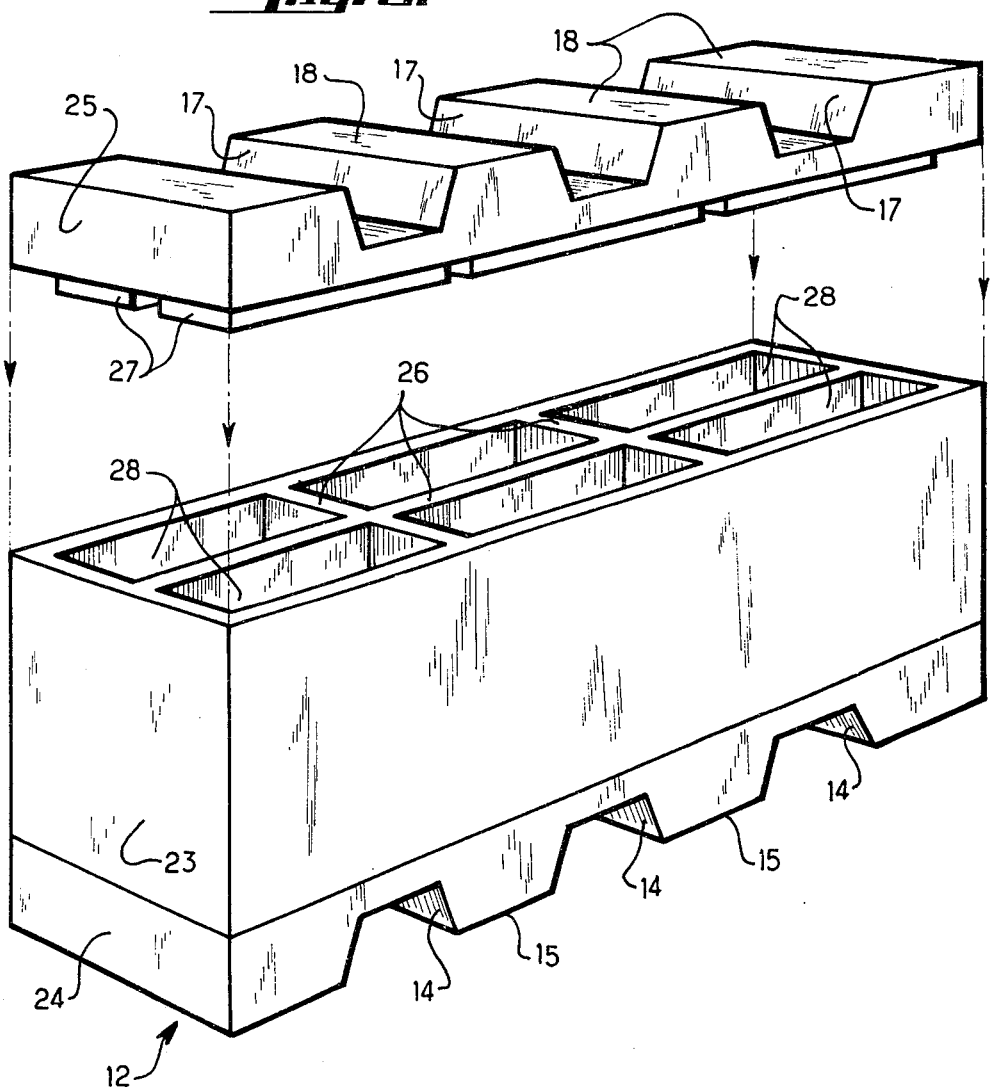
Figure 4:
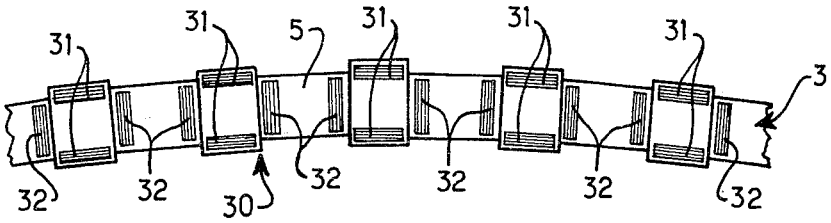

FIG. 3 is an outside perspective partially exploded detail view, drawn on a larger scale, showing an aforesaid heat insulating block; and FIG. 4 is a fragmentary top view, drawn on a smaller scale, of the diagrammatically shown resilient suspension system and of its bottom laying plane, substantially in horizontal section taken upon the line IV—IV in FIG. 1 and showing the distribution of the rubber elements in alternate pairs arranged in successive groups or sets.

Figure 2:
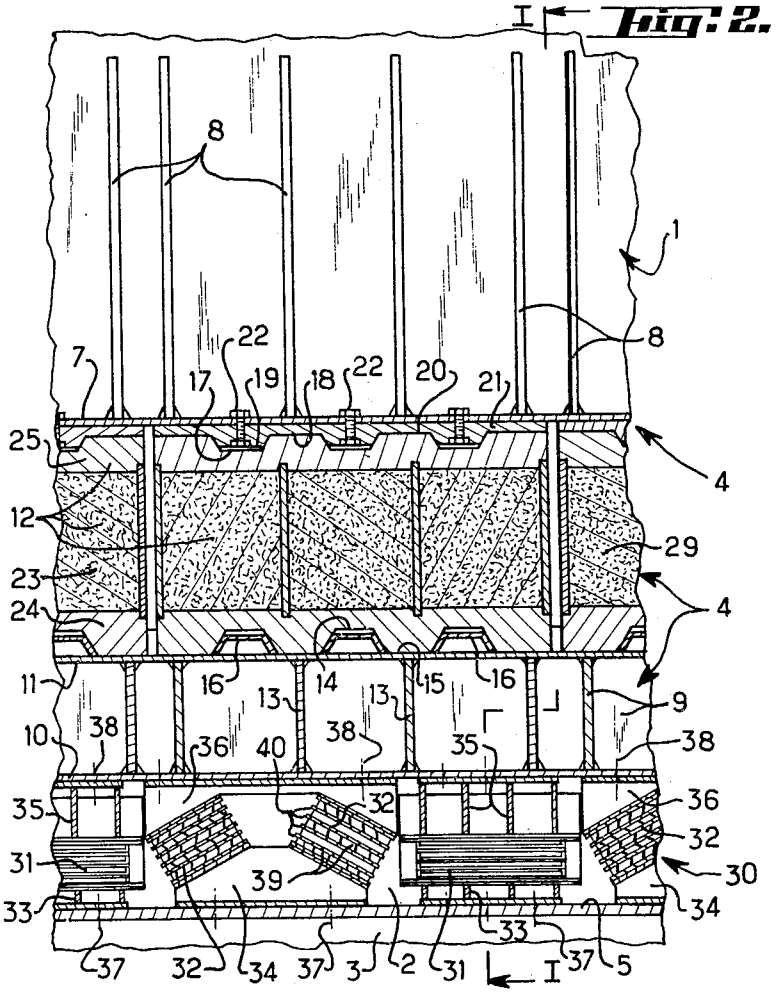
FIG. 2 is a fragmentary side view of the aforesaid assembly shown in section taken upon the broken line II—II in FIG. 1 with parts broken away.

According to the form of embodiment shown in FIGS. 1 and 2 the generally metallic heat-insulated tank generally denoted by the reference numeral 1 is a vessel of substantially spherical or spheroidal shape of large containing capacity (having for instance a diameter of about 37 m) mounted in a hold compartment 2 of the inner hull 3 of the ship. This tank is supported at its outer periphery by a supporting device 4 mounted on a coping or shelf 5 forming a kind of cornice or overhanging platform integral with the hull structure and possibly transverse bulkheads or partitions of the hold to form a kind of framing fully surrounding the tank to thereby define a trunkway or casing 6 of the hold at the lower portion or towards the bottom thereof, into which projects the downward extending lower part of the tank.

A substantially horizontal, substantially flat annular plate or flat ring 7 encompasses the tank 1 on a level lower than that of the relative horizontal equatorial plane of the tank while being welded to the outer wall of the latter to form said radially projecting bearing foot-plate which is advantageously reinforced by substantially vertical spaced stiffening gussets or webs 8 welded to both the tank and the foot-plate 7, respectively, above the latter. The tank 1 rests with this foot-plate 7 simply and substantially freely on a lower springer carried by the ledge 5 and forming the supporting pedestal or frame receiving the bearing action of the continuous annular foot-plate 7 providing mainly for the roll-holding qualities.

The aforesaid springer comprises a rigid or substantially undeformable and mechanically strong metal frame 9 having the shape of a substantially circular continuous ring serving to take over the forces, stresses or strains conveyed by the bearing foot-plate 7. This frame 9 exhibits the closed configuration of a solid annular beam or girder with a substantially vertical web extending between a lower preferably substantially flat flange 10 and an upper substantially channel-like or trough-shaped flange 11 formed with parallel vertical upstanding or upward projecting upturned side edges defining a trough-shaped or channel-like recess for accommodating or receiving the bottom portions of the heat insulating blocks 12 interposed between the bearing foot-plate 7 and the frame 9. These heat insulating blocks are place end to end in close almost joined or contiguous order while preferably leaving a gap between the successive adjacent blocks and they are fitted or nested with their bases into said trough or channel of the frame 9. The frame 9 is advantageously reinforced by spaced transversely or substantially radially extending stiffening gussets or webs 13.

Each heat insulating block 12 advantageously comprises in its bottom surface spaced flutes or grooves 14 separated by ribs or solid portions 15, respectively, and extending each one in a substantially transverse or radial direction, these flutes or hollow depressions 14 co-operating with corresponding mating or complementary projecting ribs or ridges 16 integral with the bottom of said trough or channel 11 forming said seating platform or bed-plate, so that each block is held against motion in the circumferential direction by means of its fitting or nesting engagement of its grooved bottom with the corresponding radial ribs 16 of the trough 11, each block thus bearing with the solid portions 15 of its bottom onto the corresponding flat bottom of the trough 11. Instead of several grooves 14 each heat insulating block 12 could exhibit one single groove 14 provided in its bottom. Likewise the top face of each heat insulating block 12 is also provided with at least one or several such spaced substantially radially or transversely extending grooves or flutes 17 separated by solid portions or lands 18, these grooves and solid portions being adapted to co-operate respectively with corresponding projecting ribs and hollow flutes 19 and 20, respectively, provided underneath the bearing foot-plate 7. Each heat insulating block 12 is thus fitted or nested with its lower and upper flutes and ribs, respectively, between homologous ribs and flutes belonging to the seating platform or bed-plate and to the bearing foot-plate, respectively. For allowing an adjustment and providing for a perfect bearing with sliding contact, the ribs 19 and the flutes 20 are preferably provided in an inserted wedge or shim plate 21 made from heat insulating material and secured underneath the bearing foot-plate 7 as for instance by bolts 22 extending preferably through ribs 19, respectively, and the heat or nut of each one thereof is advantageously sunk, recessed or set back into the lower face of its associated rib 19. Thus the bearing foot-plate 7 is in contacting engagement with the lands or solid portions 18 of the top face of the associated block 12. The respective complementary or mating cross-sectional profiles of said grooves and ribs are preferably substantially trapezoidal or wedge-shaped and accurately provided with a view to obtain a substantially close running or sliding fit while leaving some clearance between the bottom of each groove or re-entrant flute and the terminal or end face of each corresponding mating or complementary associated rib or ridge. The ribs 16 are for instance metallic and welded to the bottom of the channel 11, respectively. To allow some adjustment in position of each wedge or shim plate 21, each bolt hole, extending through the bearing foot-plate 7 is advantageously of elongated cross-sectional shape.

Owing to this anchoring arrangement on the one hand of the tank on the heat insulating blocks 12 and on the other hand of the heat insulating blocks 12 in the trough 11 by means of projecting locking cross parts the tank 1 will apply to the ship's structure 3 forces while are exerted substantially continuously at the level of the supporting plane 5. These forces in particular comprise a vertical force consisting of a continuous and substantially uniformly distributed static load applied to the supporting plane 5 and due to the tank being vertically supported, i.e. to the weight of the tank and of its contents as well as forces due to roll which have a substantially sinusoidal distribution and are tangential only.

Each heat insulating block 12 has advantageously the general shape of a right rectangular hollow parallelepipedic box partitioned inside and consisting for instance of a main intermediate body portion 23, of a solid massive externally grooved bottom 24 and of an externally grooved solid or massive cover or lid 25. The inner vertical longitudinal and transverse partitions 26, respectively, are dividing the inner space of the box in a number of compartments extending for instance through the main body portions 23 of the box in the direction of the height. The bottom 24 and the cover 25 respectively fit or nest with protruding portions 27 of their inner faces into the lower and upper ends, respectively, of the compartments 28 of the main body portion 23 of the box. Each box and each plate 21 are advantageously made from wood withstanding compression and shearing, for instance from bonded, glued or stuck laminated wood or from a laminated wood impregnated with phenolic resin or a like phenoplast and commercially known under the trademark "Permali" or also from a so-called "bakelized" wood or the like. The compartments of each box are advantageously filled with a heat insulating material provided preferably in an incoherent or pourable physical condition, i.e. divided in particles for instance in a powdery state such as the substance commercially known under the trade-mark "Perlite" 29. When the boxes 12 are positioned in the trough 11 of the frame 9, they are steadied, chocked up or shimmed advantageously by means of a preferably adhesive or bonding and hardenable or setting stuffing product filling the gaps and clearances such as for instance a cold-polymerizable resin or like synthetic plastics material which is injected into all the free spaces, voids or joints for stopping or filling them out and which through setting or hardening provide an adhesive or bonding connection of the boxes between each other and with the channel 11, respectively, while holding them against motion thereby to dispense with any later or further adjustment of the boxes in position.

The rigid annular frame 9 is supported by a resilient suspension system 30 comprising aforesaid quaternary assemblies circumferentially distributed substantially uniformly over the supporting surface or ledge 5 integral with the structure 3 of the ship. Each quaternary assembly consists of two pairs of spaced substantially rectangular rubber pads or cushions which are mutually opposite to or in front of each other and have their respective own longitudinal directions extending in substantially parallel relationship. The own longitudinal extent or stretch of the successive pairs of individual pads which form resilient suspension means is alternatingly directed in a locally radial or transverse direction (i.e. a direction normal to the outside wall surface of the tank) and in an orthogonal i.e. locally tangential or peripheral direction so that a pair of pads 31 extending in the tangential direction be provided between two transversely extending pads 32 as shown in particular in FIGS. 2 and 4. Both pads of each tangentially directed pair of pads 31 are preferably arranged according to a configuration converging or tapering in the upward direction while thus symmetrically pitching or sloping upwards towards each other from bottom to top whereas both pads 32 of each aforesaid transversely directed pair of pads are arranged according to a configuration diverging in the upward direction, i.e. converging or tapering in the downward direction while thereby pitching or sloping downwards towards each other symmetrically from top to bottom. As shown in FIG. 4 the pairs of transversely opposite longitudinal pads 31 and the pairs of successive longitudinal transverse opposite pads 32 are alternately directed in the radial and in the perpendicular directions thereby alternating uniformly along the circumference of the supporting plane 5 and each quaternary assembly of pads may be considered as consisting of two crosswise arranged pairs of pads symmetrically opposite to and pitching or sloping towards each other two by two so that for instance each pair of longitudinally directed pads 31 be provided between two transversely or radially directed pads 32. For a diameter of a spherical tank for instance of about 36 m or 37 m there are thus provided for instance 100 quaternary assemblies or packs of four rubber pads, their sizes being preferably such as to leave some capability of adjusting or varying their positions on the supporting plane. This supporting plane 5 is located below the horizontal equatorial plane of the spherical tank 1 for instance at an angular position $\alpha$ located 15° below the equatorial plane. As known per se both pads of each aforesaid pair of pads are mounted between two respectively lower and upper backing members, fixtures or like mounts 33, 34 and 35, 36, respectively, secured as for instance by bolting at 37, 38 onto the supporting platform 5 and the annular frame 9, respectively. These backing members, fixtures or like mounts form a kind of cradles for the respective pads. Each pad consists preferably of an alternating stack of superposed plates made alternately from metal and rubber so as to form flat rubber cushions 39 separated by preferably substantially flat metal sheets and assembled into a bound laminated package forming a multiple sandwich-like stop or abutment member.

For every aforesaid pad assembly there is a decoupling centre for the system which centre forms a neutral point which under the effect of a vertical load does not undergo any rotation but a translatory motion only. With an assembly of two longitudinally directed pads 31 which are pitching or sloping towards each other with an angle of 60° with respect to the longitudinal vertical centre plane of symmetry this decoupling centre would be located in this plane on a level higher than that of the two pads and would be defined by the intersection with this plane of a straight line inclined at an angle of about 31° with respect to this plane and extending through the centre of the rectangular end top face of a pad.

As shown in FIG. 1 the lower portion of the tank, i.e. that portion of the tank which is located below the level of the horizontal bearing foot-plate 7, is externally lined or coated on its wall with a layer of heat insulating material such as expanded polyurethane or polyvinyl chloride foam or like cellular plastics or synthetic material 41 whereas the whole space left in the hold casing 6 between the inner wall of the hull 3 of the ship and the wall of the tank 1 is advantageously filled up with a heat insulating material in particular in powdery condition such as perlite. The upper portion of the tank 1, i.e. that portion thereof which is located above the level of the top surfaces of the boxes 12, is advantageously externally lagged or heat-insulated by means of a heat insulating preferably powdery material such as for instance perlite 42 filling out the whole free space extending about the tank and left between the tank 1 and the wall of the inner hull 3. On the other hand the remaining intermediate space, i.e. the space containing and surrounding the supporting device 4 is preferably not fitted with heat insulating material so as not to compel the whole cold thermal flux originating from the tank 1 to flow through the rubber pads 31, 32 which flux would deteriorate same.

It should be understood that the invention is not at all limited to the form of embodiment described and shown which has been given by way of example only. In particular it comprises all the means constituting technical equivalents of the means described as well as their combinations if same are carried out according to its gist and used within the scope of the appended claims.

What is claimed is:

1. A device for supporting on any conveying vehicle a rigid tank for containing a fluid the temperature of which is very different from the ambient temperature, comprising a continuous annular bearing foot-plate with an at least approximatively flat bottom surface which is substantially horizontal with respect to said vehicle, said bearing foot plate surrounding said tank and being integral therewith; and a base stand secured to the structure of said vehicle and forming a resilient suspension-carrying springer means surrounding said tank, said base stand having an upper seating platform provided with a horizontal seating top surface, said bearing foot-plate resting on said seating top surface, wherein the improvement consists in that heat insulating material is interposed between said bearing foot-plate and said seating platform and consists of intermediate heat insulating blocks juxtaposed end to end in series to form a discontinuous ring-like pattern while leaving spacing gaps between the successive adjacent blocks, respectively, said blocks having top walls forming an at least approximatively uniform surface, said bearing foot-plate engaging said surface in slidable contacting relationship.

2. A device according to claim 1, including cooperating anchoring means provided between said bearing foot-plate and said seating top surface supporting same, said anchoring means being adapted to prevent said tank from being bodily displaced mechanically with overall relative motion at least horizontally i.e. in parallel relation to said seating top surface under the action of external forces while however allowing a local substantially radial motion through thermal deformation, said anchoring means comprising substantially radially directed spaced guide grooves provided on said seating top surface and projecting keys secured underneath said bearing foot-plate and slidably engaging said grooves, respectively, wherein the improvement consists in that said grooves are constituted by transversely extending flutes formed in the top surfaces of said heat insulating blocks while being regularly distributed over the latter whereas said keys consist of spaced complementary ribs provided in plates made from heat insulating material and adjustably affixed in position underneath said bearing foot-plate, said seating platform comprising means for holding said heat insulating blocks against motion in radial or transverse directions.

3. A device according to claim 2, wherein the bottom surfaces of said heat insulating blocks are also provided with said substantially transversely extending flutes co-operating with corresponding complementary projecting ribs integral with said seating top surface of said upper platform.

4. A device according to claim 1, including an aforesaid bearing foot-plate integral with a flat collar-like ring externally surrounding and integral with said tank, wherein the improvement consists in that said bearing foot-plate is directly constituted by said collar-like ring which is reinforced by gusset means.

5. A device according to claim 1, wherein said springer means comprises a substantially horizontal annular beam extending in coaxial relation to said tank and forming a rigid frame resting on resilient support means secured to said vehicle structure, said beam comprising a top flange forming a hollow recess with bilateral vertical parallel upstanding edge walls so as to provide an annular trough of substantially channel-like shape receiving and accommodating the bottoms of said heat insulating blocks and forming said seating platform.

6. A device according to claim 5, including aforesaid resilient suspension means consisting of spaced rubber pads peripherally distributed in a same substantially horizontal relative laying plane and wherein said resilient suspension means consist of a series of like successive quaternary systems peripherally distributed substantially uniformly over said laying plane, each quaternary assembly being substantially symmetrical with respect to two relative vertical centre planes extending at right angles to each other in a locally transverse direction which is radially directed or normal to the tank and in a locally tangential, circumferential direction of longitudinal extent, respectively.

7. A device according to claim 6, wherein each aforesaid quaternary assembly consists of two pairs of spaced opposite substantially rectangular rubber pads with respective substantially parallel longitudinal extents, the longitudinal extent of the successive pairs of pads which form said resilient suspension means being alterenately oriented in a locally radial or transverse direction and in an orthogonal, i.e. locally tangential or peripheral direction, respectively, so that a pair of pads extending in a tangential direction be provided between two transversely directed pads.

8. A device according to claim 7, wherein both pads of each aforesaid tangentially directed pair of pads are tapering in the upward direction while being symmetrically inclined upwards towards each other from bottom to top whereas both pads of each aforesaid transversely directed pair of pads are diverging in the upward direction while being symmetrically inclined downwards towards each other from top to bottom.

9. A device according to claim 7, wherein both pads of each aforesaid pair of pads are mounted between two cradle-like lower and upper backing members forming mounts secured to said vehicle structure and underneath said annular beam, respectively, each pad consisting of a bound laminated package forming a multiple sandwich-like cushion consisting of a stack of superposed plates alternately made from rubber and metal.

10. A device according to claim 9, for a substantially spherical tank and wherein said laying plane forming the supporting level is located below the relative horizontal equatorial plane of said tank.

11. A device according to claim 1, wherein each aforesaid heat insulating block consists of a substantially right parallelepipedic box made in particular from wood withstanding compression and shearing and internally divided into compartments by vertical longitudinal and transverse partitions, said compartments being filled with powdery heat insulating material such as perlite.

12. A device according to claim 1, wherein each aforesaid heat insulating block is steadied and held in position by an adhesive settable stuffing product forming a hardenable bonding substance selected from the group comprising a cold polymerizable resin and a plastics material injected into the gaps and void spaces for filling them out.

13. A device according to claim 1, wherein said tank is provided with an external layer of heat-insulating material which is arranged so that said springer means remain fully spaced on and outside of said heat-insulating material, said heat-insulating material comprising a layer of cellular material coating the lower portion of said tank and extending between the latter and said device up to said bearing foot-plate thereof and selected from the group comprising expanded polyurethane and polyvinyl chloride foam; and a lagging of powdery heat-insulating material such as perlite filling up the surrounding space and provided on the one hand about the upper portion of said tank down to said bearing foot-plate and on the other hand about said layer of cellular material but only downwards from and below the level of the bottom of said device.

* * * * *